United States Patent [19]

Lee

[11] Patent Number: 5,067,884

[45] Date of Patent: Nov. 26, 1991

[54] UNITIZED STRUCTURE OF MAIN BEARING AND CYLINDER OF ROTARY COMPRESSOR

[75] Inventor: Byung C. Lee, Seoul, Rep. of Korea

[73] Assignee: Goldstar Co., Ltd., Seoul, Rep. of Korea

[21] Appl. No.: 557,539

[22] Filed: Jul. 23, 1990

[30] Foreign Application Priority Data

Jul. 28, 1989 [KR] Rep. of Korea ..... 11013/1989

[51] Int. Cl.[5] ..... F04C 29/06

[52] U.S. Cl. ..... 418/63

[58] Field of Search ..... 418/63, 64, 65, 66, 418/67

[56] References Cited

U.S. PATENT DOCUMENTS 1,677,780 7/1928 Jaworowski ..... 418/63

FOREIGN PATENT DOCUMENTS 324530 2/1935 Italy ..... 418/63

60-166787 8/1985 Japan ..... 418/63

153144 11/1920 United Kingdom ..... 418/63

*Primary Examiner*—Richard A. Bertsch

*Assistant Examiner*—David L. Cavanaugh

*Attorney, Agent, or Firm*—Anthony J. Casella; Gerald E. Hespos

[57] ABSTRACT

A unitized structure of a main bearing and a cylinder of a rotary compressor is disclosed. The cylinder is formed integrally with and directly in the main bearing. Further, the inner circumferential corner of the cylinder is shaped in a round form, and the corresponding circumferential corner of the roller is shaped also in a round form. According to the present invention, the fastidious adjusting procedure required in assembling the conventional compressor and the drop of the effciency due to the variation of the clearance between the cylinder and the main bearing are all eliminated, thereby improving the productivity and the product quality.

1 Claim, 2 Drawing Sheets

UNITIZED STRUCTURE OF MAIN BEARING AND CYLINDER OF ROTARY COMPRESSOR

FIELD OF THE INVENTION

The present invention relates to a unitized structure of a main bearing and a cylinder of a rotary compressor, in which the main bearing and the cylinder are formed in a unitized structure so that the processing and the assembling of the compressor should become easier.

BACKGROUND OF THE INVENTION

The structure of the conventional rotary compressor as shown in FIGS. 4 and 5 is constituted such that a revolution shaft 1 driven by a motor 10 is revolved; an eccentrically installed roller 11 revolves within a cylinder 12; a vane 13 is installed in such a manner as to move up and down in accordance with the revolutions of the roller 11 in order to momentarily form spaces between the wall of the cylinder 12 and the eccentric roller 11; the space is separated into a suction room 14 and a compressing room 15 by means of the vane 13; the gas is sucked into the suction room 14 through an inlet hole 16; and the gas is compressed in the compressing room 15 to discharge the compressed gas through a discharge hole 17, thereby forming a cylinder stroke, and forming circulating cycles through the repetitions of the strokes.

The conventional rotary compressor constituted as above is assembled in such a manner that; the revolution shaft 1 is inserted into the centre hole of a main bearing 2; the enccentric roller 11 is fitted from the side of the leading end of the shaft 1; the cylinder 12 is sub-assembled to the main bearing 2 as shown in FIG. 6; in this state, the clearance between the eccentric roller 11 and the cylinder 12 is checked at each angular position by rotating the shaft 2; and then, the cylinder 12 is fastened to the main bearing 2 by means of a securing bolt 18.

However, in such a conventional rotary compressor, the cylinder and the main bearing are formed in separate components, and in a state with the cylinder and the main bearing sub-assembled, the clearance between the cylinder and the eccentric roller has to be adjusted by rotating the eccentric roller.

But the tolerance for the dimension of the clearance is so very fastidious as to have to come within several micrometers, and therefore, there is the disadvantage that the assembling is difficult, and that the assembling time is extended. Further, after assembling between the cylinder and the main bearing through the fastidious adjustment, biased forces are acted due to the difference of the pressures acting on the compressing room and the suction room during the long use of the compressor, and therefore, the position of the fastening bolt can displace little by little. With the result that the clearance between the cylinder and the eccentric roller is varied and that gas is leaked through the slit thus formed, the efficiency of the compressor can be deteriorated.

Further, in the case where the displacement of the cylinder is severe, an excessive load is imposed on the cpmpressor, to such an extent that the operation of the compressor is stopped.

SUMMARY OF THE INVENTION

The present invention is intended to overcome the above described disadvantages of the conventional device. Therefore it is the object of the present invention to provide a unitized structure of the main bearing and the cylinder of a rotary compressor, in which the main bearing and the cylinder are integrally formed in order to prevent the displacement of the cylinder relative to the main bearing and to remove the assembling difficulty thereof.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
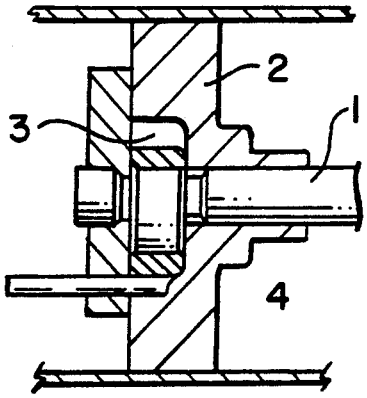
FIG. 1 is a sectional view of the unitized cylinder and main bearing of the rotary compressor according to the present invention.
Figure 2:
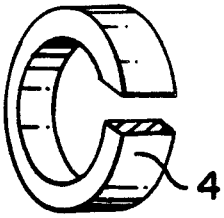
FIG. 2 is a perspective view of the partly cut-out roller of the compressor according to the present invention.
Figure 3:
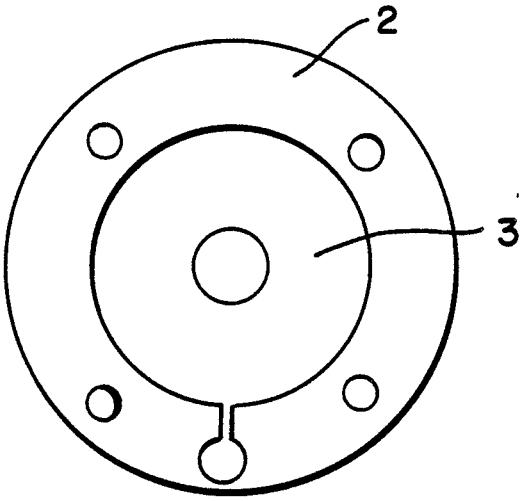
FIG. 3 is a frontal view of the unitized cylinder and main bearing.
Figure 4:
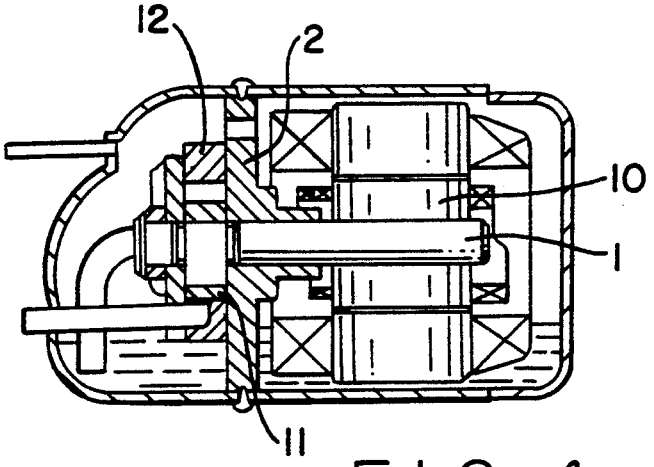
FIG. 4 PRIOR ART
FIG. 4 is a sectional view of the structure of the conventional rotary compressor.
Figure 5:
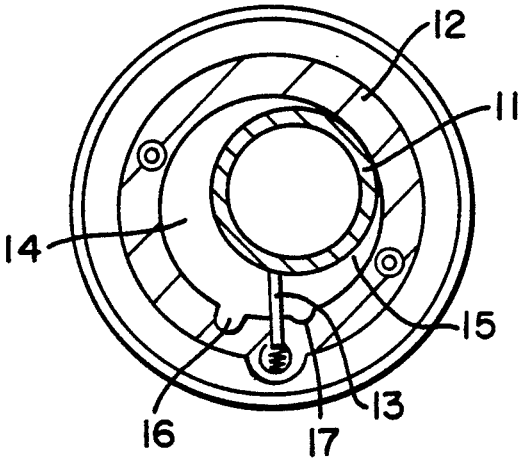
FIG. 5 PRIOR ART
FIG. 5 is a sectional view taken along the line A—A of FIG. 4.
Figure 6:
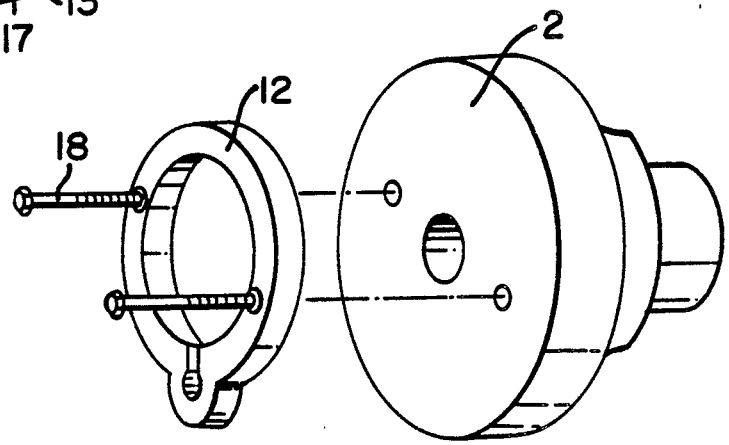
FIG. 6 PRIOR ART
FIG. 6 is an exploded perspective view of the cylinder and main bearing of the conventional rotary compressor.

A cylinder 3 is directly formed in the body of a main bearing 2 into which a revolution shaft 1 is inserted, and an eccentric roller 4 is installed within the cylinder 4 in such a manner that the eccentric roller 4 should revolve in contact with the inner wall of the cylinder 3. The rotary compressor constituted as above according to the present invention is operated in the same manner as that of the conventional rotary compressor. The difference of the constitution is that the rotary compressor of the present invention has the main bearing 2 in which the cylinder 3 is directly formed, whereas the conventional rotary compressor has a cylinder and a main bearing which are formed separately and assembled together. According to the present invention, the clearance between the cylinder 3 and the eccentric roller 4 is adjusted only by fitting the roller 4 to the eccentric head of the revolution shaft 1.

Accordingly, the conventional process of adjusting the clearance between the cylinder 3 and the roller 4 by rotating the roller 4 in order to adjust the coupling between the cylinder 3 and the main bearing is not required, but the assembling of the cylinder 3 and the roller 4, and the adjustment of the clearance therebetween are achieved without undergoing the fastidious adjustment of the main bearing and the cylinder. Therefore, any displacement of the cylinder 3 relative to the main bearing 2 can not occur because the main bearing 2 is firmly welded to the shell of the compressor and because the cylinder 3 and the main bearing 2 are integrally formed, although biased forces act within the cylinder 3 due to the difference of the pressures acting on the compressing room and the suction room.

Further, the inner circumferential corner of the cylinder 3 which is formed in the main bearing 2 is provided with a round shape, and the circumferential corner of the roller 4 which is correspond with the inner circumferential corner of the cylinder 3, is also shaped in a round form, thereby reducing the frictions between the cylinder 3 and the roller 4. In the rotary compressor of the present invention, the principle of the sucking and compressing cycles is the same as that of the conventional rotary compressor.

As described above, according to the present invention, the roller performs compressing functions revolving within the cylinder which is integrally formed with the main bearing. Therefore, the complicated assembling process and the extended assembling time which are seen in the conventional device are all eliminated. Further, the fastidious adjusting procedure is also eliminated, with the result that the manufacturing cost is saved, and that the overall performance of the compressor is also improved.

What is claimed is:

1. A rotary compressor comprising: a revolution shaft; a main bearing having a planar base wall fitted around said revolution shaft and aligned orthogonal thereto; a cylinder formed integrally with and directly in said main bearing, said cylinder defining an inner circumferential wall aligned substantially orthogonally to the planar base wall of the main bearing; a curved corner wall extending between the inner circumferential wall and the planar base wall of the main bearing; and a roller eccentrically fitted to said revolution shaft and revolving within said cylinder, said roller comprising an outer cylindrical surface in contact with the inner circumferential wall of said cylinder, a planar wall in contact with the planar base wall of the main bearing and a curved corner wall extending between the planar wall and the outer cylindrical wall and conforming to the shape of the curved corner wall of the main bearing, whereby the curved corner wall of the main bearing and the curved corner wall of the roller enable low friction between the roller and the bearing.

* * * * *